US007967340B2

(12) United States Patent
Hofer et al.

(10) Patent No.: US 7,967,340 B2
(45) Date of Patent: Jun. 28, 2011

(54) SLIP AND PROTECTIVE LABEL ASSEMBLY

(75) Inventors: Gene A. Hofer, Lake Zurich, IL (US); Michael S. Weinhammer, Round Lake, IL (US); Michael W. Paul, Round Lake, IL (US)

(73) Assignee: ZIH Corp., Hamilton (BM)

( * ) Notice: Subject to any disclaimer, the term of this patent is extended or adjusted under 35 U.S.C. 154(b) by 938 days.

(21) Appl. No.: 11/833,001

(22) Filed: Aug. 2, 2007

(65) Prior Publication Data

US 2008/0030019 A1 Feb. 7, 2008

Related U.S. Application Data

(60) Provisional application No. 60/821,214, filed on Aug. 2, 2006.

(51) Int. Cl.
*B42D 15/00* (2006.01)

(52) U.S. Cl. ..... 283/81; 283/60.1; 283/103; 283/106; 283/116

(58) Field of Classification Search ..... 281/51; 283/55, 60.1, 81, 103, 105, 106, 116, 117
See application file for complete search history.

(56) References Cited

U.S. PATENT DOCUMENTS

| | | | | |
|---|---|---|---|---|
| 4,598,935 | A * | 7/1986 | Stewart | 283/81 |
| 4,868,027 | A * | 9/1989 | Hunkeler et al. | 283/103 |
| 5,376,418 | A | 12/1994 | Rogers et al. | |
| 5,484,168 | A | 1/1996 | Chigot | |
| 5,618,064 | A | 4/1997 | Main | |
| 5,618,600 | A | 4/1997 | Denklau | |
| 5,659,987 | A | 8/1997 | Scheggetman | |
| 5,730,469 | A | 3/1998 | Heimerdinger et al. | |
| 5,776,571 | A | 7/1998 | Michlin et al. | |
| 6,186,554 | B1 | 2/2001 | Raming | |
| 6,213,518 | B1 | 4/2001 | Raming | |
| 6,786,263 | B1 | 9/2004 | Fox, Jr. et al. | |
| RE38,976 | E | 2/2006 | Raming | |
| 2002/0113428 | A1 | 8/2002 | Phillips et al. | |

OTHER PUBLICATIONS

Webpage: http://foxiv.com/index.cfm?page=packing-slip-system; downloaded Oct. 29, 2008; 1 sheet.
Video: http://foxiv.com/flash/fox-iv/QuickSlip/; downloaded Oct. 29, 2008; 2 sheets.
Video: http://www.duplexpacklist.com/; downloaded Oct. 29, 2008; 2 sheets.
International Search Report for International Application No. PCT/US2007/075090, mailed Mar. 25, 2008 (7 pages).

* cited by examiner

*Primary Examiner* — Dana Ross
*Assistant Examiner* — Justin V Lewis
(74) *Attorney, Agent, or Firm* — Alston & Bird LLP

(57) ABSTRACT

Slip and protective label assemblies are provided, as well as methods of manufacture and application to a receiving face. In one case, the assembly includes a slip layer and a protective layer, with the slip layer divided into a slip portion that is printed upon, a surrounding border portion, and a tab portion. The reverse side of the slip layer is coated with a release coating such that the slip layer may be removably laminated to the protective layer using an adhesive. In another case, direct thermal stock is laminated to an intermediate layer to form a slip laminate, which is adhered to a protective layer to form the assembly. In all cases, the border portion of the slip layer or slip laminate may be removed to attach the label to a receiving face, and the protective layer may be peeled away to provide access to the printed slip portion.

23 Claims, 6 Drawing Sheets

SLIP AND PROTECTIVE LABEL ASSEMBLY

CROSS-REFERENCE TO RELATED APPLICATIONS

This application claims the benefit of U.S. Provisional Application No. 60/821,214, filed Aug. 2, 2006.

BACKGROUND

It is common practice in shipping to use a label to carry the shipping address for a package and a separate packing list to describe the package contents. Typically, the packing list is placed inside the package or in a clear plastic pouch or envelope attached by adhesive to the outside of the package. The advantage of the pouch or envelope is that information regarding the contents can be obtained without opening the package.

Several prior art inventions have combined the shipping label and packing list on a common multilayer form so they are printed simultaneously by an impact printing device that can print through multiple layers with carbons or equivalents. Others have made the shipping label and packing list coplanar for printing side-by-side or sequentially in a non-impact printer such as a thermal or laser printer. None of these labels, however, are useful for direct thermal printing applications. In direct thermal printing, heat is applied directly to the stock to create the printed image, and as a result direct thermal stock is more sensitive to light, heat, and abrasion than other types of stock. Thus, labels made from direct thermal stock are often susceptible to "bruising" or kinetic imaging during production, handling, and/or shipping. Unwanted images or markings on the stock may, at best, obscure the printed packing list or, at worst, make the label unusable.

Thus, there is a need for a unitary printable slip and protective label assembly that may be used for direct thermal printing applications, is easy to affix to a receiving face, and provides for quick and reliable access to the slip.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Embodiments of the present invention now will be described more fully hereinafter with reference to the accompanying drawings in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention provide a printable slip with an integral plastic over-label for fastening the slip to a receiving face and protecting the slip, as well as methods of manufacturing and applying such a printable slip. The label is configured to conceal the information on the printable surface and requires no folding or separate manipulation of the slip to arrange the slip beneath the protective label.

Figure 1:
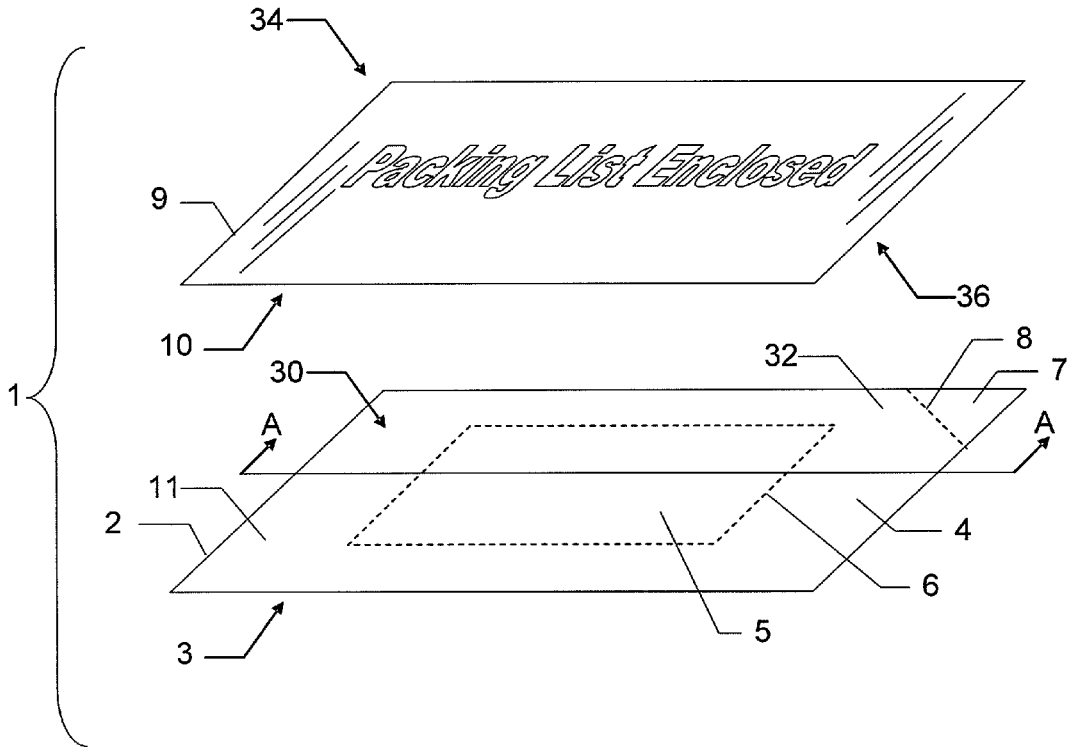
FIG. 1 is an exploded view of the slip and protective label assembly according to one embodiment.
Figure 1A:
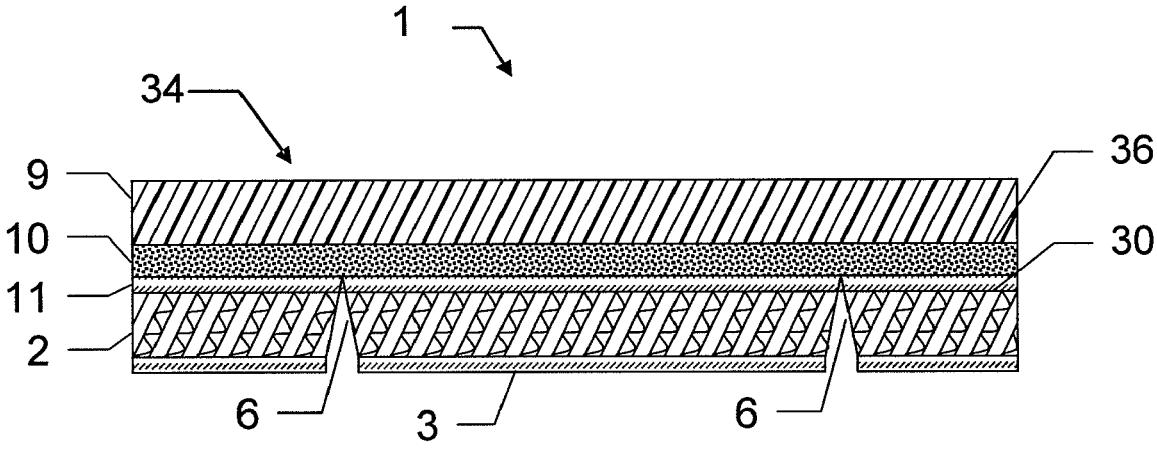
FIG. 1A is a cross section of the slip and protective label assembly of FIG. 1 along the section indicated as A-A in FIG. 1.

With reference to FIGS. 1 and 1A, a single slip and protective label assembly is shown according to one embodiment. The assembly, however, may be fabricated as a continuous web of such assemblies, from which FIG. 1 can be considered to represent one assembly torn from or cut from such a web, and such a web is considered to lie within the scope of the claims.

With continued reference to FIGS. 1 and 1A, the slip and protective label assembly 1 comprises a slip layer 2 and a protective layer 9. The slip layer 2 defines a first surface 30 and a printable second surface 3. The slip layer 2 may include, for example, paper stock having a heat sensitive coating applied to the second surface 3 for direct thermal printing. Slip layer 2 further defines a border portion 4 and a slip portion 5. The border portion 4 is configured to at least partially enclose the slip portion 5. For example, as shown in FIG. 1, the slip portion 5 may be centrally located and surrounded on all sides by the border portion 4. The border portion 4 and the slip portion 5 may be formed using a die cut 6, completely surrounding the slip portion 5 and completely penetrating the slip layer 2. The border portion 4 may also define a liner portion 32 and a tab portion 7, for example by means of a second die cut 8. Although a die cut is used in the illustrated embodiments to describe the mechanism by which the border portion 4 and the slip portion 5, as well as the liner portion 32 and tab portion 7, are formed, in other embodiments these portions may be formed using other means. For example, respective portions may be formed by a punch cut, scissor cut, or score, among other ways.

The protective layer 9, which may be made of a clear plastic film, defines a first surface 34 and a second surface 36. The second surface 36 includes an adhesive coating 10 such that the first surface 30 of the slip layer 2 may be removably laminated to the second surface 36 of the protective layer 9. For example, the protective layer 9 may be a topcoated, heat set, biaxially oriented, co-extruded polypropylene film, such as the Fasson® 2 Mil Clear BOPP TC/S692N/40# BG film. The adhesive coating 10 may be an acrylic adhesive with short-term removability, such as the Fasson® S692N adhesive, which has a peel adhesion to high density polyethylene (HDPE) of 1.1-1.7 lbs at room temperature. Test methods used to obtain peel adhesion data such as this may include ASTM D3330/D3330M-00 (Standard Test Method for Peel Adhesion of Pressure-Sensitive Tape), as well as other standards. In this way, the protective layer 9 may be affixed to a receiving face (for example, to an object at a shipping origin), remain attached to the receiving face for a time (for example, during shipment of the object), and subsequently be removed from the receiving face (for example, from the object at a shipping destination), as will be described in further detail below. Furthermore, the protective layer 9 may include a pre-printed notice that a slip is contained beneath it, as shown in FIG. 1.

With reference to FIG. 1A, the first surface 30 of the slip layer 2 opposite the printable second surface 3 may be coated with a release coating 11, which in some cases may include a silicone material. The release coating 11 may serve to weaken the adhesion of the slip layer 2 to the protective layer 9 so as to render the two separable with the adhesive coating 10 remaining attached to the protective layer 9 and thus capable of reattachment to a receiving face.

Figure 2:
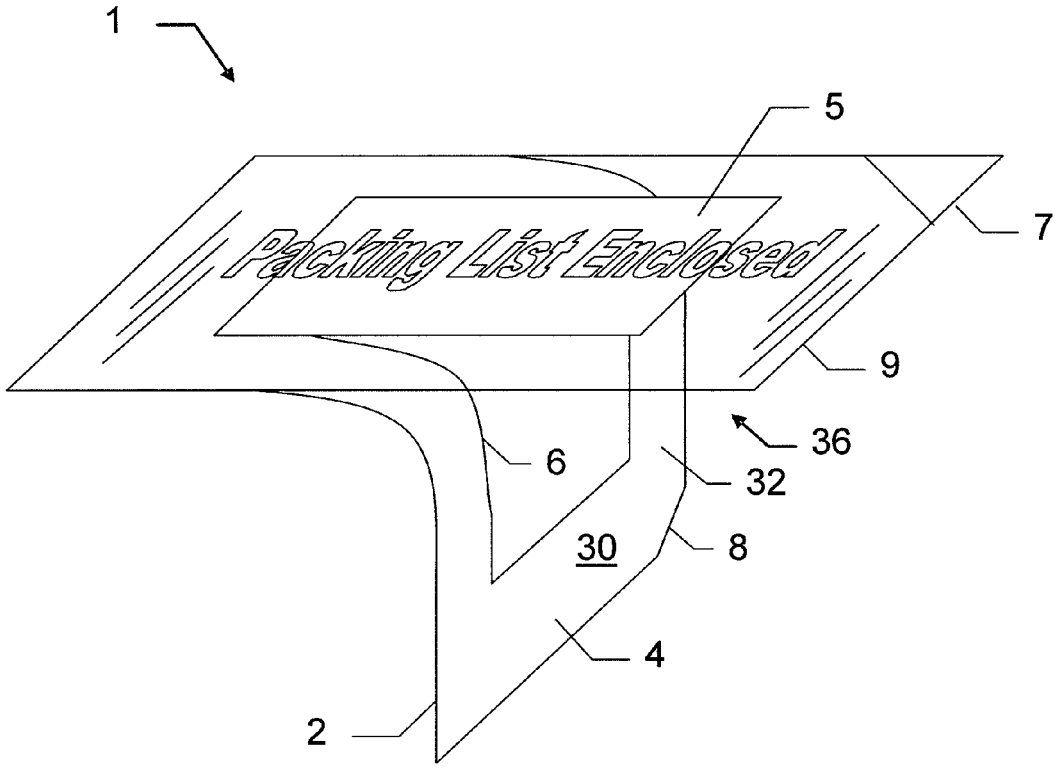
FIG. 2 is an isometric view of the layers of the assembly being separated prior to application to an object according to one embodiment.

FIG. 2 shows the slip and protective label assembly 1 as readied for application to a receiving face according to one embodiment. The border portion 4 of slip layer 2 may be manually separated from the protective layer 9, releasing at the weakened bond between the release coating and the adhesive coating while leaving the adhesive coating attached to the second surface 36 of the protective layer 9. In this embodiment, the slip portion 5 and the tab portion 7, however, become detached from the liner portion 32 of the border portion 4 due to the die cuts 6 and 8, respectively, as the border portion 4 is peeled away from the protective layer 9. The slip portion 5 and the tab portion 7 remain attached to the second layer 36 of the protective layer 9 pending application of the assembly 1 to the receiving face. Thus, for example, a user may peel off the liner portion 32 of the border portion 4 of the slip layer 2 and discard the liner portion 32, in the process exposing the adhesive coating of the protective layer 9 where the liner portion 32 was removed.

Figure 3:
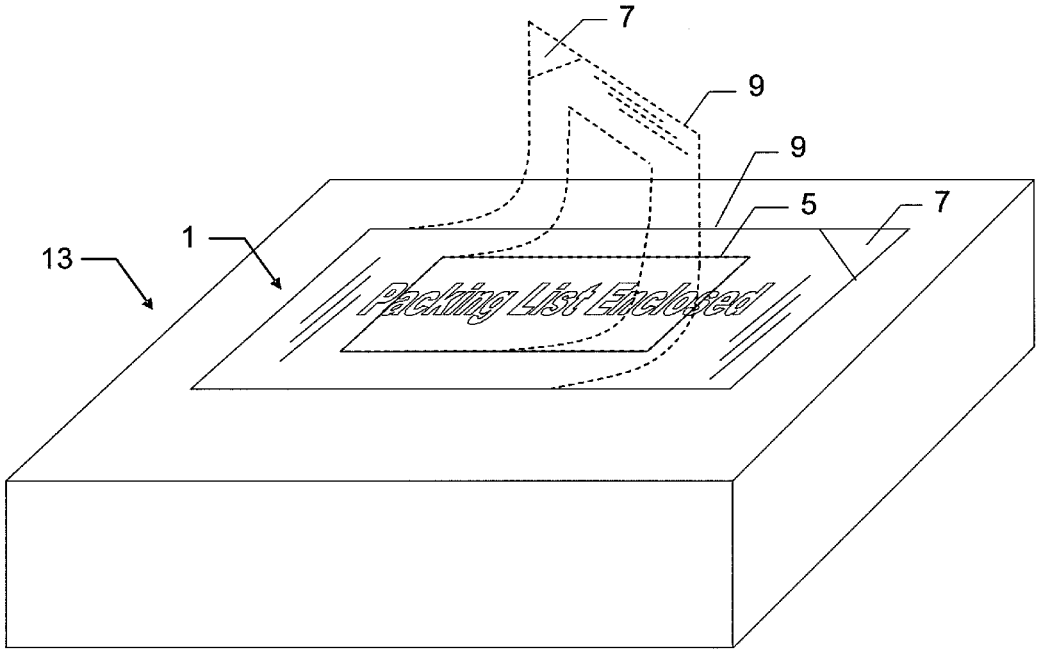
FIG. 3 is an isometric view of the slip and protective label as applied to an object with dashed lines showing how it is removed from the object for inspection of the slip according to one embodiment.

Once the liner portion 32 is removed, the slip and protective label assembly 1 may be applied to the receiving face, for example, the side of an object 13 as shown in FIG. 3. In this regard, the object 13, which may be in some cases a package to be shipped, may have multiple receiving faces on which the assembly 1 may be affixed. For example, an object 13 similar to the one depicted in FIG. 3 may have 6 potential receiving faces. In other embodiments, however, the receiving face may be a wall or any other surface on which the assembly 1 may be affixed. For ease of discussion, however, an object 13, such as a package that is to be shipped from a shipping origin to a shipping destination, will be used to describe embodiments of the assembly 1.

By affixing the assembly 1 to the object 13, the slip portion 5 of the slip layer 2 is enclosed between the object 13 and the protective layer 9. The protective layer 9 is attached to the object 13 by the adhesive coating 10 (shown in FIGS. 1 & 1A) in the area where the liner portion 32 of the border portion 4 was removed (i.e., everywhere except at the locations beneath the slip portion 5 and the tab portion 7). The slip and protective label assembly 1 is configured to remain attached to the object 13 during shipping from the shipping origin to the shipping destination.

At the shipping destination, the slip portion 5 may be accessed by another user (e.g., a recipient of the object). To access the slip portion 5 in some embodiments, the tab portion 7 may be gripped by the user (as it is not attached to the object 13) and used to lift the protective layer 9 away from the object 13, as shown in FIG. 3 by the dashed lines. The protective layer 9 may be configured such that it is substantially free of perforations. In this way, the entire protective layer 9 may be removed when the user removes the assembly 1 from the object 13. In some cases, the slip portion 5 may remain weakly attached to the protective layer 9 by virtue of the adhesive coating and the release coating (not shown). As a result, the user may remove the slip portion 5 from the protective layer 9 by peeling the two apart in order to inspect the slip portion 5. In other cases, the slip portion 5 may remain on the object (although not attached) after the protective layer 9 is peeled away to be picked up by the user for inspection.

Referring again to FIG. 1, in some embodiments the application of the release coating 11 to the slip layer 2 described above may require a high temperature cure during the manufacturing process. When the slip layer 2 includes a direct thermal stock, such a high temperature cure during the manufacturing process may degrade or thermally image the printable second surface 3 of the slip layer 2, rendering the second surface 3 less desirable, if not unusable, for printing purposes. In such cases, the slip and protective label assembly 1 may be provided as shown in FIGS. 4 and 4A and described below.

Figure 4:
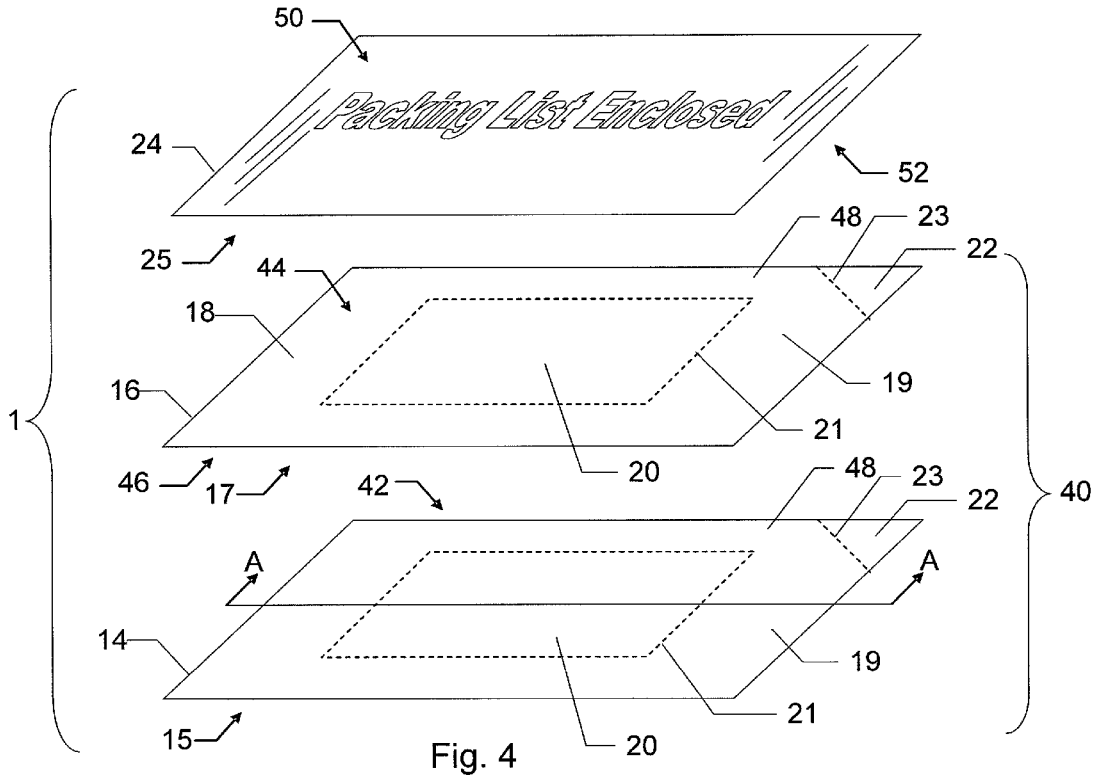
FIG. 4 is an exploded view of the slip and protective label assembly according to another embodiment.

In the slip and protective label assembly 1 shown in FIG. 4, a slip laminate 40 is provided in lieu of the slip layer 2 of the embodiment of FIG. 1. Although a single label is shown in FIG. 4, the assembly 1 may be fabricated as a continuous web of such assemblies, from which FIG. 4 can be considered to represent one assembly torn from or cut from such a web, and such a web is considered to lie within the scope of the claims.

Figure 4A:
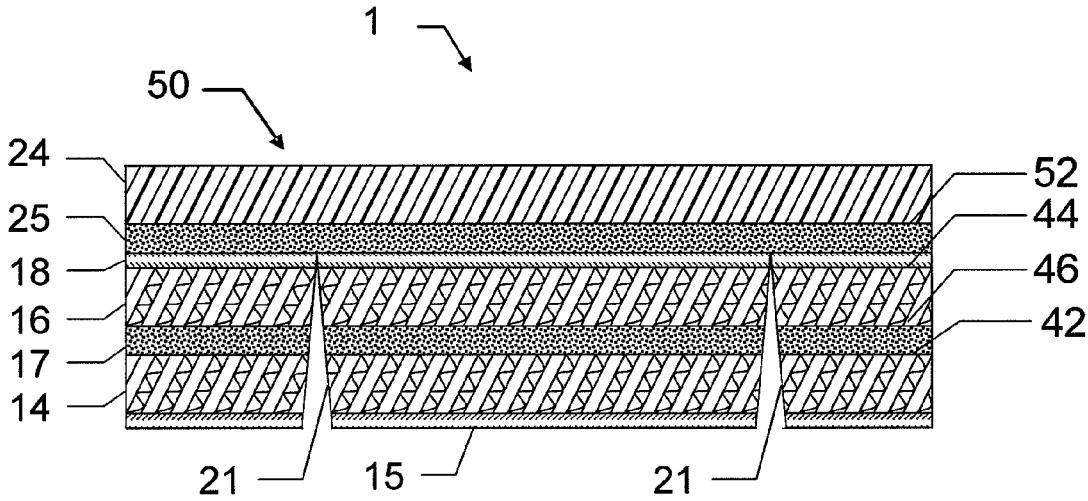
FIG. 4A is a cross section of the slip and protective label assembly of FIG. 4 along the section indicated as A-A in FIG. 4.

Referring to FIGS. 4 and 4A, the slip laminate 40 comprises an intermediate layer 16 that is laminated to a slip layer 14. As with the slip layer 2 of FIG. 1, the slip layer 14 may be made of paper and may include direct thermal stock that is adapted for printing by a direct thermal printer. The slip layer 14 of the slip laminate 40 defines a first surface 42 and a printable second surface 15 suitable for direct thermal printing. In some cases, a liner of the direct thermal stock may need to be removed to expose the first surface 42 of the slip layer 14. The intermediate layer 16 also defines a first surface 44 and a second surface 46. The second surface 46 of the intermediate layer 16 includes an adhesive coating 17 such that the intermediate layer 16 may be laminated to the slip layer 14 (e.g., via a non-heated pressure roller). The first surface 44 of the intermediate layer 16 in some embodiments includes a release coating 18, which may include a silicone material as previously described.

The slip laminate 40 formed by joining of the slip layer 14 and the intermediate layer 16 is divided into a border portion 19 and a slip portion 20 using a die cut 21 or other means (as discussed above). As previously described, the slip portion 20 may be centrally located such that the slip portion 20 is surrounded on all sides by the border portion 19. The border portion 19 and slip portion 20 may be formed using a die cut 21 or other means, completely surrounding slip portion 20 and completely penetrating the slip laminate 40. The border portion 19 may also define a liner portion 48 and a tab portion 22, for example via a second die cut 23.

As with previous embodiments, the protective layer 24 defines a first surface 50 and a second surface 52. The slip laminate 40 is removably laminated to the protective layer 24 by an adhesive coating 25, which is included on the second surface 52 of the protective layer 24. The protective layer 24 may further include a pre-printed notice that a slip is contained beneath it, as shown in FIG. 4. With reference to FIG. 4A, the first surface 44 of intermediate layer 16 (opposite the printable second surface 15 of the slip layer 14) may be coated with the release coating 18 in some embodiments, which weakens the adhesion of the slip laminate 40 to the adhesive coating 25 so as to render the two separable, with the adhesive coating 25 remaining attached to the protective layer 24 and thus capable of reattachment to a receiving face. In some cases, the second surface 46 of the intermediate layer 16 and the first surface 42 of the slip layer 14 carry no such release coating, and thus the two layers remain laminated (i.e., the slip laminate 40 remains intact) during use. As a result, the slip laminate 40 may be functionally equivalent to the slip layer 2 of the embodiment shown in FIG. 1 with respect to the applications explained in FIGS. 2 and 3.

FIGS. 1 and 4 illustrate embodiments of the present invention in which the die cuts 6, 21 only extend through the slip layer 2 and the slip laminate 40. In these embodiments, the tab portion 7, 22 may be used to remove the protective layer 9, 24, respectively, from the receiving face (such as the side of an object) to gain access to the slip portion 5, 20. In other embodiments, the slip portion 5, 20 may be removed from the receiving face while leaving the outer portions of the protective layer 9, 24 in place. In these embodiments, for example, the die cuts 6, 21 could be perforations. In these respective embodiments, the die cut 6 would extend through both the slip layer 2 and the protective layer 9, and the die cut 21 would extend through the slip layer 14, the intermediate layer 16, and the protective layer 24. Optionally, a tab similar to the tab portion 7, 22 may be provided as part of the slip portion 5, 20 on corner edges thereof. In these embodiments, the slip portion 5, 20 may be removed via the die cuts, while the remaining portions of the protective layer 9, 24 remain adhered to the receiving face. The portions of the protective layer 9, 24 that respectively remain adhered to the slip portion 5, 20 after the slip portion 5, 20 has been removed from the receiving face can either remain adhered to the slip portion 5, 20 or the removed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A slip and protective label assembly comprising:

a protective layer defining a first surface and a second surface, wherein the second surface includes an adhesive coating; and a slip layer defining a first surface, a second surface, a slip portion, and a border portion that at least partially encloses the slip portion, wherein the first surface of the slip layer is removably laminated to the second surface of the protective layer, wherein the border portion of the slip layer defines a liner portion and a tab portion, wherein the liner portion of the border portion is configured to be removed from the protective layer and detached from the slip portion and the tab portion to expose at least a portion of the adhesive coating of the protective layer for affixing the assembly to a receiving face, and wherein the tab portion is configured to be grasped by a user during removal of the assembly from the receiving face.

2. The slip and protective label assembly of claim 1, wherein the protective layer is configured to be substantially free of perforations such that the entire protective layer is removed when the user removes the assembly from the receiving face.

3. The slip and protective label assembly of claim 1, wherein the second surface of the slip layer further comprises a heat sensitive coating.

4. The slip and protective label assembly of claim 1, wherein the second surface of the slip layer further comprises a release coating.

5. The slip and protective label assembly of claim 1, wherein the protective layer is configured to be affixed to an object.

6. A slip and protective label assembly comprising:

a protective layer defining a first surface and a second surface, wherein the second surface includes an adhesive coating; and a slip laminate comprising an intermediate layer laminated to a slip layer, wherein the slip layer comprises direct thermal stock that is adapted for printing by a direct thermal printer, wherein the slip laminate defines a slip portion and a border portion at least partially enclosing the slip portion, and wherein at least part of the border portion of the slip laminate is configured to be removed from the protective layer and detached from the slip portion to expose at least a portion of the adhesive coating of the protective layer for affixing the assembly to a receiving face.

7. The slip and protective label assembly of claim 6, wherein the intermediate layer is laminated to the slip layer by a non-heated pressure roller.

8. The slip and protective label assembly of claim 6, wherein the border portion of the slip laminate defines a liner portion and a tab portion, wherein the liner portion of the border portion is configured to be removed from the protective layer and detached from the slip portion and the tab portion to expose at least a portion of the adhesive coating of the protective layer for affixing the assembly to the receiving face, and wherein the tab portion is configured to be grasped by a user during removal of the assembly from the receiving face.

9. The slip and protective label assembly of claim 6, wherein a first surface of the intermediate layer includes a release coating.

10. The slip and protective label assembly of claim 9, wherein the intermediate layer and the slip layer are configured such that one of the intermediate layer and the slip layer may be laminated to the other of the intermediate layer and the slip layer to form the slip laminate without activating the release coating.

11. The slip and protective label assembly of claim 6, wherein the protective layer is configured to be substantially free of perforations to allow a user to readily remove the entire protective layer from the receiving face.

12. The slip and protective label assembly of claim 6, wherein the intermediate layer and the slip layer are configured such that one of the intermediate layer and the slip layer may be laminated to the other of the intermediate layer and the slip layer to form the slip laminate without imaging the slip layer.

13. The slip and protective label assembly of claim 6, wherein the protective layer is configured to be affixed to an object.

14. A method of manufacturing a slip and protective label assembly comprising:

providing a protective layer defining a first surface and a second surface, wherein the second surface includes an adhesive coating;

providing an intermediate layer defining a first surface and a second surface, wherein the first surface includes a release coating and the second surface includes a pressure sensitive adhesive disposed thereon;

providing a slip layer comprising direct thermal stock defining a printing surface and a non-printing surface;

pressing the non-printing surface of the slip layer against the second surface of the intermediate layer to form a slip laminate such that the first surface of the intermediate layer defines a first slip laminate surface and the printing surface of the slip layer defines a second slip laminate surface;

forming the slip laminate into a border portion and a slip portion such that at least part of the border portion is separable from the slip portion; and removably laminating the first slip laminate surface to the second surface of the protective layer.

15. The method of claim 14, wherein pressing the non-printing surface of the slip layer against the second surface of the intermediate layer comprises laminating the slip layer and the intermediate layer without activating the release coating of the first surface of the intermediate layer.

16. The method of claim 14, wherein pressing the non-printing surface of the slip layer against the second surface of the intermediate layer comprises laminating the slip layer and the intermediate layer without imaging the printing surface of the slip layer.

17. The method of claim 14, wherein forming the slip laminate into the border portion and the slip portion comprises die-cutting the slip laminate.

18. The method of claim 14 further including forming the border portion of the slip laminate into a liner portion and a tab portion, wherein the liner portion is configured to be removed from the protective layer and detached from the slip portion and the tab portion to expose at least a portion of the adhesive coating of the protective layer for affixing the assembly to a receiving face, wherein the tab portion is configured to be grasped by a user during removal of the assembly from the receiving face.

19. A method of affixing and accessing a slip comprising:

providing a protective label including a slip laminate and a protective layer removably laminated to the slip laminate, wherein the slip laminate defines a border portion and a slip portion, and wherein the border portion of the slip laminate further defines a liner portion and a tab portion;

printing an image on the slip portion of the slip laminate of the protective label;

removing the liner portion of the border portion of the slip laminate from the slip portion and the tab portion of the slip laminate and from the protective layer;

affixing the protective label to a receiving face, wherein the printed image of the slip portion is proximate the receiving face; and removing the protective label from the receiving face to provide access to the slip portion by grasping the tab portion to peel the protective label off the receiving face.

20. The method of claim 19, wherein printing the image comprises applying the image using direct thermal printing.

21. The method of claim 19, wherein the affixing step occurs at a shipping origin.

22. The method of claim 19, wherein the removing step occurs at a shipping destination.

23. The method of claim 19 further comprising removing the slip portion from the protective label after removing the protective label from the receiving face.

* * * * *